US010643576B2

(12) United States Patent
Lee

(10) Patent No.: US 10,643,576 B2
(45) Date of Patent: May 5, 2020

(54) SYSTEM AND METHOD FOR WHITE SPOT MURA DETECTION WITH IMPROVED PREPROCESSING

(71) Applicant: Samsung Display Co., Ltd., Yongin-si, Gyeonggi-do (KR)

(72) Inventor: Janghwan Lee, Pleasanton, CA (US)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 15/978,045

(22) Filed: May 11, 2018

(65) Prior Publication Data

US 2019/0189083 A1 Jun. 20, 2019

Related U.S. Application Data

(60) Provisional application No. 62/599,249, filed on Dec. 15, 2017, provisional application No. 62/648,288, filed on Mar. 26, 2018.

(51) Int. Cl.
*G09G 5/10* (2006.01)
*G09G 3/20* (2006.01)

(52) U.S. Cl.
CPC ..... *G09G 5/10* (2013.01); *G09G 3/20* (2013.01); *G09G 3/2007* (2013.01); *G09G 2320/0242* (2013.01); *G09G 2320/0693* (2013.01)

(58) Field of Classification Search
CPC ..... G09G 2320/0242; G09G 5/10
See application file for complete search history.

(56) References Cited

U.S. PATENT DOCUMENTS

| | | | |
|---|---|---|---|
| 5,917,935 | A | 6/1999 | Hawthorne et al. |
| 6,154,561 | A | 11/2000 | Pratt et al. |
| 7,443,498 | B2 | 10/2008 | Yoshida |
| 8,145,008 | B2 | 3/2012 | Chen et al. |
| 8,368,750 | B2 | 2/2013 | Mori et al. |

(Continued)

FOREIGN PATENT DOCUMENTS

| | | |
|---|---|---|
| KR | 10-2014-0073259 | 6/2014 |
| KR | 10-1608843 | 4/2016 |

OTHER PUBLICATIONS

Guo, LongYuan et al.; Sub-Pixel Level Defect Detection Based on Notch Filter and Image Registration, Article, International Journal Pattern Recognition Artificial Intelligence, vol. 32, No. 6, World Scientific Publishing Company, Dec. 21, 2017, 15 pages.

(Continued)

*Primary Examiner* — Insa Sadio
(74) *Attorney, Agent, or Firm* — Lewis Roca Rothgerber Christie LLP

(57) ABSTRACT

A system and method for identifying white spot Mura defects on a display. The system and method generates a first filtered image by filtering an input image using a first image filter. First potential candidate locations are determined using the first filtered image. A second filtered image is generated by filtering an input image using a second image filter and second potential candidate locations are determined using the second filtered image. A list of candidate locations is produced, where the list of candidate locations is of locations in both the first potential candidate locations and the second potential candidate locations.

20 Claims, 13 Drawing Sheets

(56) References Cited

U.S. PATENT DOCUMENTS

| | | | | |
|---|---|---|---|---|
| 8,743,215 | B1 | 6/2014 | Lee | |
| 9,129,374 | B2 | 9/2015 | Xu | |
| 9,275,442 | B2 | 3/2016 | Ivansen et al. | |
| 9,633,609 | B2 | 4/2017 | Kao et al. | |
| 10,054,821 | B2 | 8/2018 | Jing et al. | |
| 2005/0007364 | A1 | 1/2005 | Oyama et al. | |
| 2005/0210019 | A1 | 9/2005 | Uehara et al. | |
| 2005/0271262 | A1 | 12/2005 | Yoshida | |
| 2012/0148149 | A1 | 6/2012 | Kumar et al. | |
| 2013/0100089 | A1* | 4/2013 | Xu | G09G 3/006 345/204 |
| 2013/0315477 | A1 | 11/2013 | Murray et al. | |
| 2014/0225943 | A1* | 8/2014 | Shiobara | G09G 3/3413 345/694 |
| 2016/0012759 | A1 | 1/2016 | Kim et al. | |
| 2016/0140917 | A1 | 5/2016 | Hyung et al. | |
| 2017/0122725 | A1 | 5/2017 | Yeoh et al. | |
| 2017/0124928 | A1 | 5/2017 | Edwin et al. | |
| 2018/0301071 | A1 | 10/2018 | Zhang et al. | |

OTHER PUBLICATIONS

Zhang, Yu et al.; Fabric Defect Detection and Classification Using Gabor Filters and Gaussian Mixture Model, Article, Asian Conference on Computer Vision, ACCV, 2009, pp. 635-644.

Wei, Zhouping, et al., "A median-Gaussian filtering framework for Moire pattern noise removal from X-ray microscopy image", CIHR—Canadian Institutes of Health Research, Micron, Feb. 2012, 7 pages.

Office action issued in related U.S. Appl. No. 15/909,893 by the USPTO, dated Aug. 22, 2019, 13 pages.

Non-Final Rejection issued in U.S. Appl. No. 15/909,893, dated Oct. 5, 2018, 12 pages.

Final Rejection issued in U.S. Appl. No. 15/909,893, dated Apr. 19, 2019, 14 pages.

Advisory Action issued in U.S. Appl. No. 15/909,893, dated Jun. 24, 2019, 5 pages.

European Patent Office Search Report issued in European Application No. 18212811.6, dated Apr. 25, 2019, 9 pages.

Chen, Shang-Liang et al., "TFT-LCD Mura Defect Detection Using Wavelet and Cosine Transforms", Journal of Advanced Mechanical Design, Systems, and Manufacturing, 2008, pp. 441-453, vol. 2, No. 3.

Sindagi, Vishwanath A. et al., "OLED Panel Defect Detection Using Local Inlier-Outlier Ratios and Modified LBP", 14th IAPR International Conference on Machine Vision Applications, Miraikan, Tokyo, Japan, May 18-22, 2015, MVA Organization, pp. 214-217.

U.S. Appl. No. 15/909,893, filed Mar. 1, 2018.

* cited by examiner

SYSTEM AND METHOD FOR WHITE SPOT MURA DETECTION WITH IMPROVED PREPROCESSING

CROSS-REFERENCE TO RELATED APPLICATION(S)

The present application claims priority to, and the benefit of, U.S. Provisional Patent Application No. 62/599,249, filed on Dec. 15, 2017 and U.S. Provisional Patent Application No. 62/648,288, filed on Mar. 26, 2018, the contents of which are incorporated herein by reference in their entirety.

The present application is related to U.S. patent application Ser. No. 15/909,893, filed on Mar. 1, 2018, the contents of which are incorporated by reference in its entirety.

BACKGROUND

1. Field

Some embodiments of the present disclosure relate generally to a display defect detection system.

2. Description of the Related Art

As display resolutions and pixel densities have increase, the difficulty in performing defect detection has also increased. Manual defect detection is too time consuming for modern manufacturing facilities, while automated inspection techniques are often ineffective. For example, in automated surface inspection, defects in uniform (e.g. non-textured) surfaces can be easily identified when the local anomalies have distinct contrasts from their regular surrounding neighborhood. Defects in the low-contrast images, however, are difficult to detect when the defects have no clear edges from their surroundings and the background presents uneven illumination.

One common type of display defect is "Mura." Mura is a large category of defects that have a local brightness non-uniformity. Mura can be roughly classified as line Mura, spot Mura, and region Mura depending on the size and general shape of the Mura. Each type of Mura may not have distinct edges and may not be readily apparent in images. Thus, identifying Mura using an automated testing system has proved difficult in the past. A new method of identifying Mura defects is therefore needed.

In various examples, classifying certain instances as having or not having Mura may be exceptionally difficult. For example, "high dot" instances are when a single pixel or a small group of pixels appears to be white. In many cases, these "high dot" instances do not represent Mura, but instead are a stain on the display glass or introduced by camera noise. In another example, "black dot" instances include black dots inside of a white spot. Both instances of "high dot" and "black dot" may lead to the false classification of white spot Mura.

The above information is only for enhancement of understanding of the background of embodiments of the present disclosure, and therefore may contain information that does not form the prior art.

SUMMARY

Some embodiments of the present disclosure provide a system and method for Mura defect detection in a display. In various embodiments, the system includes a memory and a processor configured to execute instructions stored on the memory. The instructions, when executed by the processor, cause the processor to generate a first filtered image by filtering an input image using a first image filter, determine first potential candidate locations using the first filtered image, generate a second filtered image by filtering an input image using a second image filter, determine second potential candidate locations using the second filtered image, and produce a list of candidate locations that include locations in both the first potential candidate locations and the second potential candidate locations.

In various embodiments, the first image filter includes a median filter and the second image filter comprises a Gaussian filter.

In various embodiments, the system generates image patches for each candidate location, and each patch includes a portion of the input image centered at the candidate location.

In various embodiments, the system is further configured to extract a feature vector for each of the image patches.

In various embodiments, the system is configured to classifying the image patches, using a machine learning classifier, using the feature vector to determine when the image patch has white spot Mura.

In various embodiments, the machine learning classifier comprises a support vector machine.

In various embodiments, determining potential candidate locations includes identifying at least one local maxima candidate in the first filtered input image, adding each identified local maxima candidate to a candidate list, and filtering local maxima candidates in the candidate list by removing each local maxima candidate from the candidate list when the local maxima candidate has a value less than a noise tolerance threshold.

In various embodiments, the system is further configured to preprocess the input image which includes performing Gaussian smoothing on the input image and normalizing the smoothed input image by mapping a dynamic range of the smoothed input image to an expected range.

In various embodiments, a method for identifying Mura candidate locations in a display includes generating a first filtered image by filtering an input image using a first image filter, determining first potential candidate locations using the first filtered image, generating a second filtered image by filtering an input image using a second image filter, determining second potential candidate locations using the second filtered image, and producing a list of candidate locations. In various embodiments, the list of candidate locations includes locations in both the first potential candidate locations and the second potential candidate locations.

In various embodiments, the first image filter includes a median filter and the second image filter includes a Gaussian filter.

In various embodiments, the method further includes generating image patches for each candidate location. In various embodiments, the image patches each include a portion of the input image centered at the candidate location.

In various embodiments, the method further includes extracting a feature vector for each of the image patches.

In various embodiments, the method further includes classifying the image patches, using a machine learning classifier, using the feature vector to determine when the image patch has white spot Mura.

In various embodiments, the machine learning classifier includes a support vector machine.

In various embodiments, determining potential candidate locations includes identifying at least one local maxima candidate in the first filtered input image, adding each identified local maxima candidate to a candidate list, and filtering local maxima candidates in the candidate list by removing each local maxima candidate from the candidate list when the local maxima candidate has a value less than a noise tolerance threshold.

In various embodiments, the method further includes preprocessing an input image. In various embodiments, preprocessing includes performing Gaussian smoothing on the input image and normalizing the smoothed input image by mapping a dynamic range of the smoothed input image to an expected range.

In various embodiments, a method for identifying Mura candidate locations in a display includes generating a first filtered image by filtering an input image using a first image filter, determining first potential candidate locations using the first filtered image, generating a second filtered image by filtering an input image using a second image filter, determining second potential candidate locations using the second filtered image, producing a list of candidate locations that include locations in both the first potential candidate locations and the second potential candidate locations, generating image patches for each candidate location that each include a portion of the input image centered at the candidate location, extracting a feature vector for each of the image patches, and classifying the image patches, using a machine learning classifier, using the feature vector to determine when the image patch has white spot Mura.

In various embodiments, the first image filter includes a median filter and the second image filter includes a Gaussian filter.

In various embodiments, the machine learning classifier includes a support vector machine.

In various embodiments, determining potential candidate locations includes identifying at least one local maxima candidate in the first filtered input image, adding each identified local maxima candidate to a candidate list, and filtering local maxima candidates in the candidate list by removing each local maxima candidate from the candidate list when the local maxima candidate has a value less than a noise tolerance threshold.

BRIEF DESCRIPTION OF THE DRAWINGS

Some embodiments can be understood in more detail from the following description taken in conjunction with the accompanying drawings, in which.

DETAILED DESCRIPTION

Figure 1A:
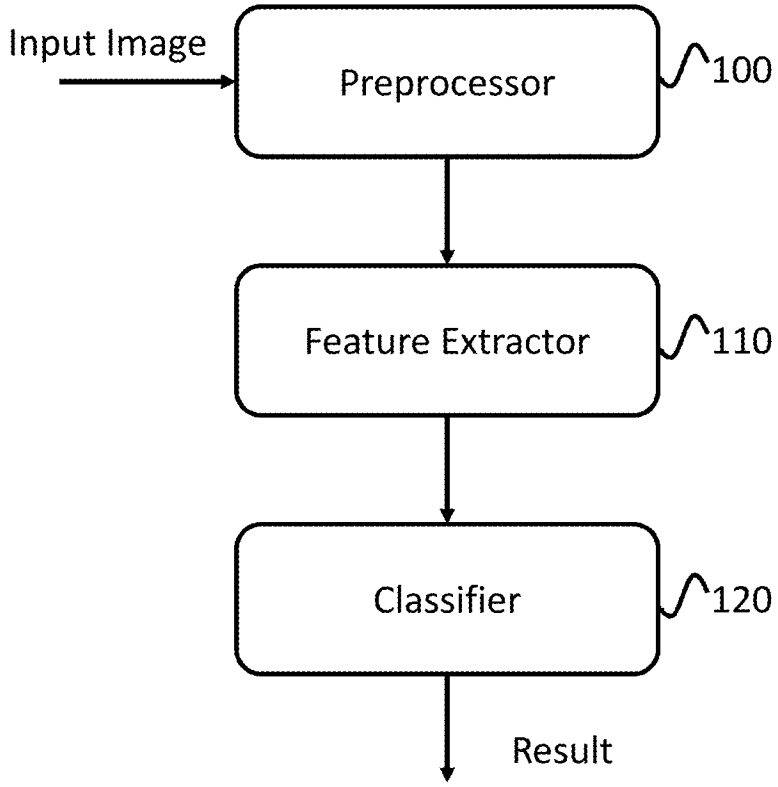
FIG. 1A depicts a system overview according to various embodiments of the present disclosure.

Features of the inventive concept and methods of accomplishing the same may be understood more readily by reference to the following detailed description of embodiments and the accompanying drawings. Hereinafter, embodiments will be described in more detail with reference to the accompanying drawings, in which like reference numbers refer to like elements throughout. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art. Accordingly, processes, elements, and techniques that are not necessary to those having ordinary skill in the art for a complete understanding of the aspects and features of the present disclosure may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

In the following description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

Embodiments of the present disclosure include a system and method for Mura detection on a display. In various embodiments, the system receives an input image of a display showing a test image. The received input image may be divided into image patches. In various embodiments, the system may preprocess the image with a candidate detector that identifies regions of the display with defect candidates and generates the image patches based on the locations of the defect candidates. In various embodiments, the defect detector also filters potential candidates related to "high" dot errors (e.g. errors where a single pixel or a small portion of pixels are white and generally correspond to stains on the glass of a display or camera noise) and "black dot" errors where there are black dots inside of a white spot. Filtering out more candidates using the candidate detector allows for better classification accuracy by simplifying the classification and despite increasing the preprocessing time, reduces overall system runtime.

Figure 1B:
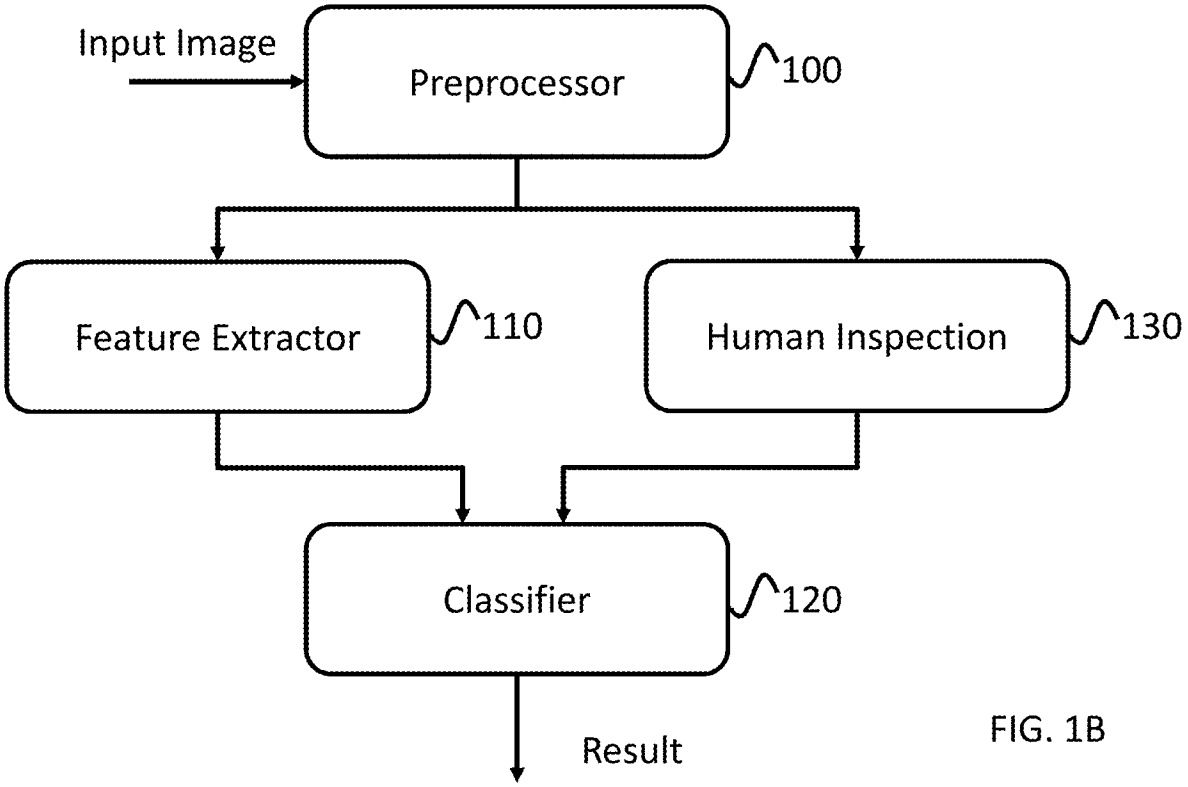
FIG. 1B depicts a system overview for training the classifier according to various embodiments of the present disclosure.
Figure 2:
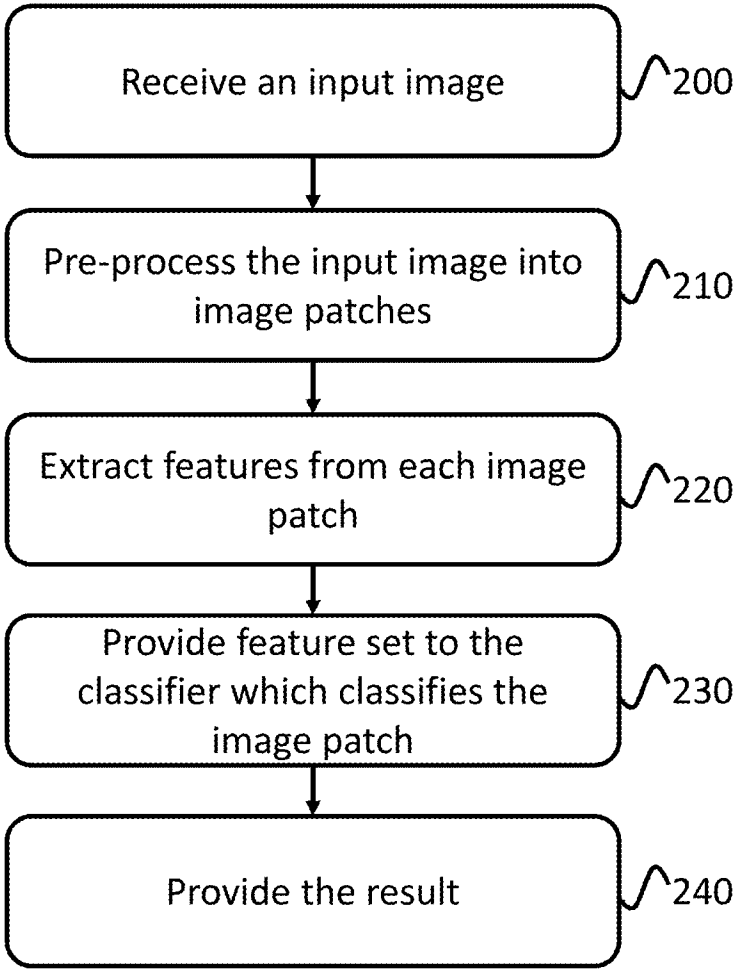
FIG. 2 depicts a method of classifying images according to various embodiments of the present disclosure.

FIG. 1A depicts a system overview according to various embodiments of the present disclosure. FIG. 1B depicts a system overview for training the classifier according to various embodiments of the present disclosure. FIG. 2 depicts a method of classifying images according to various embodiments of the present disclosure.

Referring to FIGS. 1A, 1B, and 2, in various embodiments, the Mura detection system receives an input image at a preprocessor 100 (200). The input image may, for example, include an image of a display that is showing a test image. A camera may be used to generate a test image by taking a picture of the OLED displaying a test image. In various embodiments, the test image may include an image that is likely to cause a display to exhibit instances of white spot Mura. For example, the test image may be a uniform image exhibiting low levels of contrast. The input image may also be of high enough resolution to show the individual pixels of the display being inspected for defects (e.g. white spot Mura). In various embodiments, the preprocessor 100 may be configured to receive the input image and perform smoothing to reduce the noise in the image. After reducing the noise in the input image, the preprocessor 100 may be configured to divide the image into a plurality of image patches (210). Each of the image patches may then be supplied to a feature extractor 110.

In various embodiments, the feature extractor 110 is configured to calculate various statistical features for a supplied image patch (220). For example, the statistical features may include one or more image moments (e.g. a weighted average of pixels' intensities) and one or more texture measurements (e.g. texture analysis using a Gray-Level Co-Occurrence Matrix (GLCM)). For example, in various embodiments, 37 statistical features including various image moments and GLCM texture features are extracted by the feature extractor 110. In various embodiments, the feature extractor 110 may be configured to calculate mu 30 moments (3rd order centroid moments), contrast (GLCM), Hu 5 moments (Hu moments), Hu 1 moments (1st Hu invariant moment), and correlation/dissimilarity (GLCM) for each image patch.

In various embodiments, the statistical features of each image patch extracted are supplied as input to the classifier 120 (230). In various embodiments, the classifier 120 is a machine learning classifier that uses the extracted features (e.g. a feature vector) and label class information to identify instances of defects (e.g. Mura) (240). In various embodiments, the class information is supplied by training the classifier.

In various embodiments, the classifier utilizes a supervised learning model and therefore is trained before being functional. In some embodiments, the supervised learning model used in the classifier 120 is a support vector machine. The supervised learning model (e.g. the support vector machine) may be trained by providing human input 130 to the classifier 120 during the training phase. For example, for each image patch, a human may visually inspect the patch and mark any instances of white spot Mura. The image patches are also provided to the feature extractor 110. The feature vector extracted for the image patch and the corresponding human inspected and marked patch are both provided to the classifier 120. The classifier 120 utilizes these provided patches to generate class information (i.e. builds a model) for later use in classification.

Figure 3:
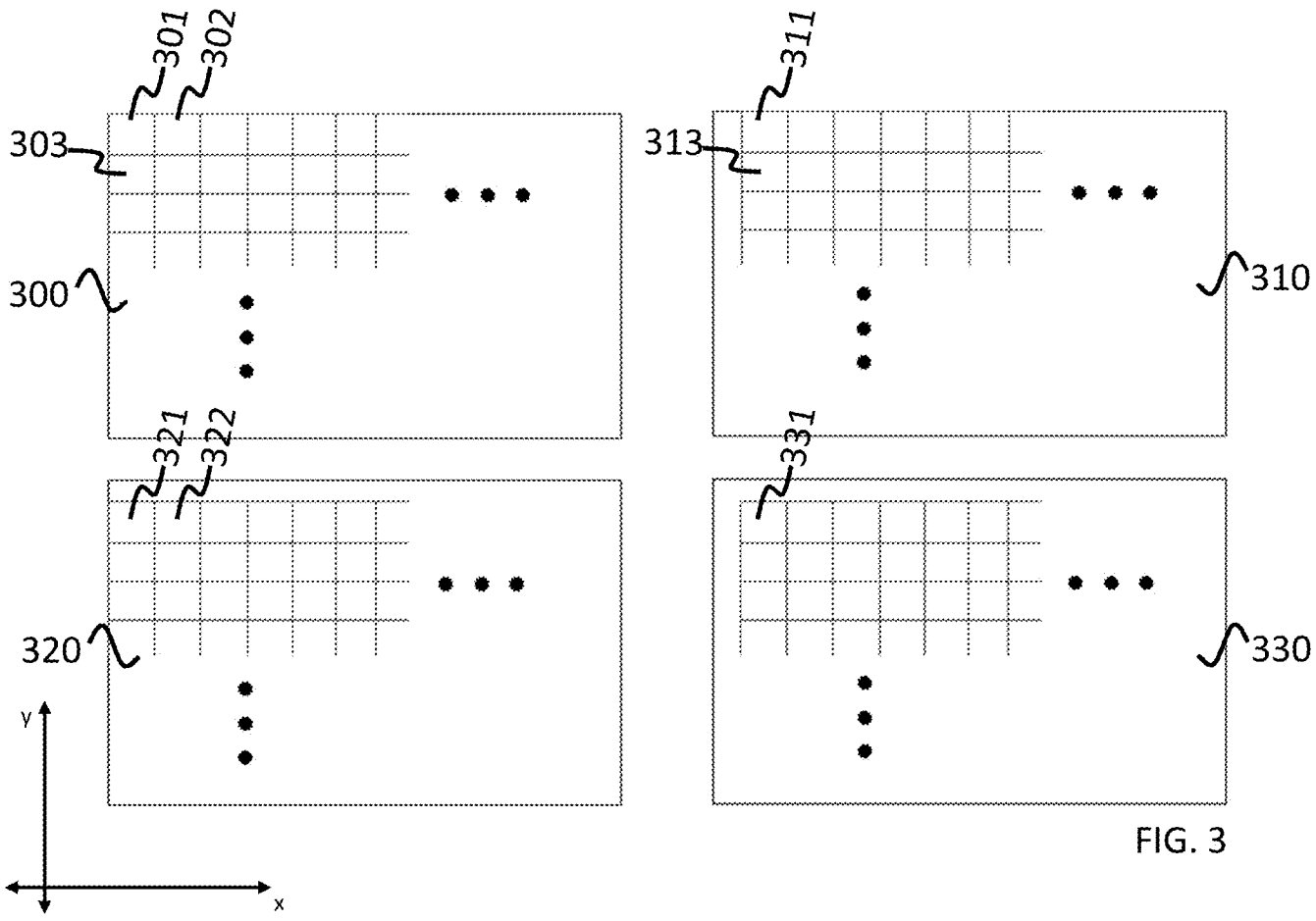
FIG. 3 depicts an dividing an image into image patches according to various embodiments of the present disclosure.

FIG. 3 depicts dividing an image into image patches according to various embodiments of the present disclosure.

Referring to FIG. 3, in various embodiments, the white spot Mura detection system may divide an input image into a plurality of image patches 301-333. In various embodiments, the input image includes a relatively high resolution image of a display. For example, the display may have a QHD (2560×1440) resolution and the input image may include a high enough resolution to depict the individual pixels of the QHD display. In various embodiments, the preprocessor may divide the input image into 32 display pixel by 32 display pixel patches (e.g. the patches include an image depicting 1024 total pixels from the display). In some embodiments, the patches may use a sliding window method that includes overlapping patches. For example, the image patches may overlap by any number of pixels (e.g. the patches may overlap by sliding a single pixel, two pixels etc.). For example, FIG. 3 includes patches that half-overlap in two directions (e.g. an x-direction and a y-direction). In each example, the image patches are slid in the x-direction and/or the y-direction to produce a new set of overlapping patches. For example, a first set of patches 300 includes 32 pixel by 32 pixel non-overlapping image patches that cover the entire input image. The first set of patches 300 includes the patch 301 in the upper left corner of the input image, the patch 302 is directly to the right of the patch 301 and the patch 303 directly below the patch 301. A second set of patches 310 half-overlaps the first set of patches in the x-direction (e.g. the second set of patches are shifted to the right 16 pixels). For example, the patch 311 is shifted 16 pixels in the x-direction (e.g. to the right) from the patch 301 and half-overlaps the patches 301 and 302.

A third set of patches 320 have been shifted down by 16 pixels and half-overlap the first set of patches 300. For example, the patch 321 is shifted 16 pixels down (e.g. in the y-direction) relative to the patch 301 and half-overlaps the patches 301 and 303. The fourth set of patches 330 is shifted down 16 pixels relative to the second set of patches 310. Thus, the patch 331 half-overlaps the patches 311 and 312. The patch 331 also half over-laps the patches 321 and 322.

Utilizing half-overlapping image patches covering the entire input image may be inefficient due to the large number of image patches created. The large number of patches is particularly cumbersome for training purposes since a supervised learning model may have human input for each image patch. Additionally, sometimes the image patches yield defects along the periphery of a patch. Having patches that include the defect centered in each patch may be preferable for more reliable classification.

Figure 4:
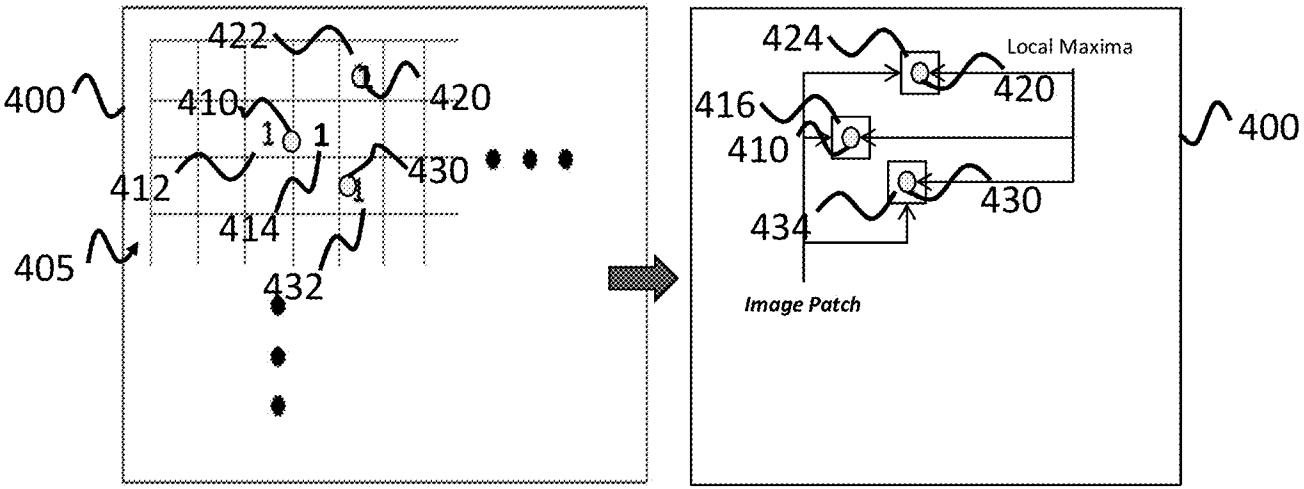
FIG. 4 depicts dividing an image into image patches utilizing a candidate detector according to various embodiments of the present disclosure.

FIG. 4 depicts dividing an image into image patches utilizing a candidate detector according to various embodiments of the present disclosure.

Referring to FIG. 4, in various embodiments, an input image 400 may be divided into a plurality image patches using a Mura candidate detector. For example, in various embodiments, the input image 400 may include one or more instances of white spot Mura 410, 420, 430. In the embodiment described above with respect to FIG. 3, a plurality of patches 405 covering the entire input image 400 would be generated. In some cases, the instances of white spot Mura may be located near the edge or overlapping an edge of one or more image patches. For example, a first instances of white spot Mura 410 is located at the edge of the image patches 412 and 414 (both marked 1 to show an instance of white spot Mura). A second instance of white spot Mura 430 is located at the edge of the image patch 432. In this example, a third instance of white spot Mura 420 is located near the center of the image patch 422. In some cases, image patches with instances of spot Mura located towards the side of an image patch may have different statistical model features than cases of white spot Mura located in the center of an image patch. Thus, a machine learning model may need to be trained to identify each edge case to be effective. Training the model to identify each edge case may be time intensive and require a large amount of human supervision for a supervised machine learning model. Furthermore, using a sliding method to generate image patches may produce a very large number of image patches which requires higher processing time for classification. Thus, to reduce training and processing time, while increasing accuracy, a spot Mura candidate detector may be utilized.

Figure 5A:
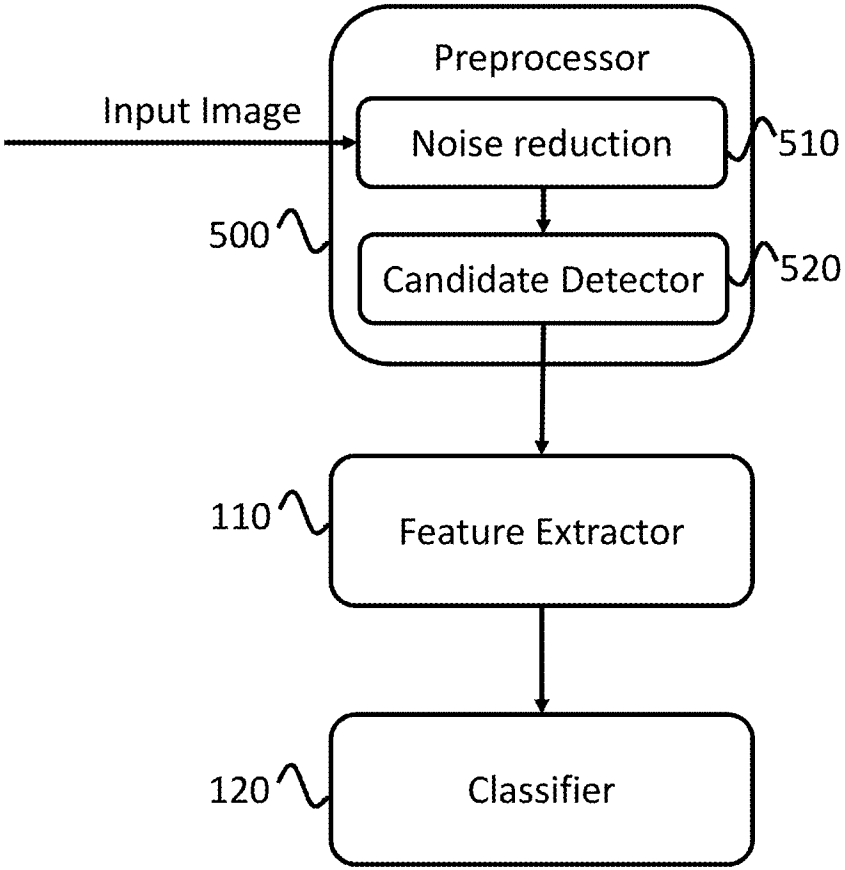
FIG. 5A depicts a system overview having a candidate detector according to various embodiments of the present disclosure.
Figure 5B:
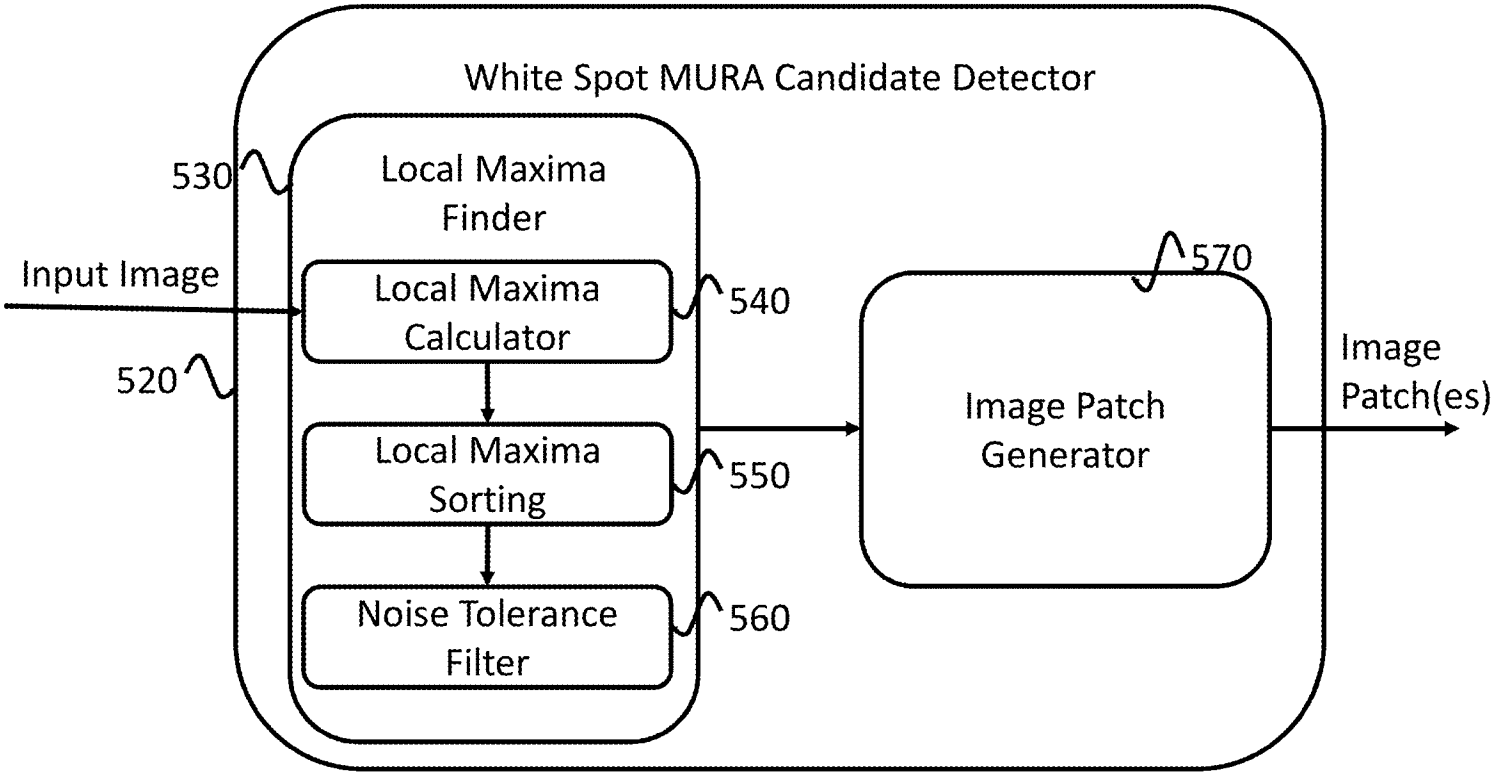
FIG. 5B depicts a more detailed view of a candidate detector according to various embodiments of the present disclosure.
Figure 6:
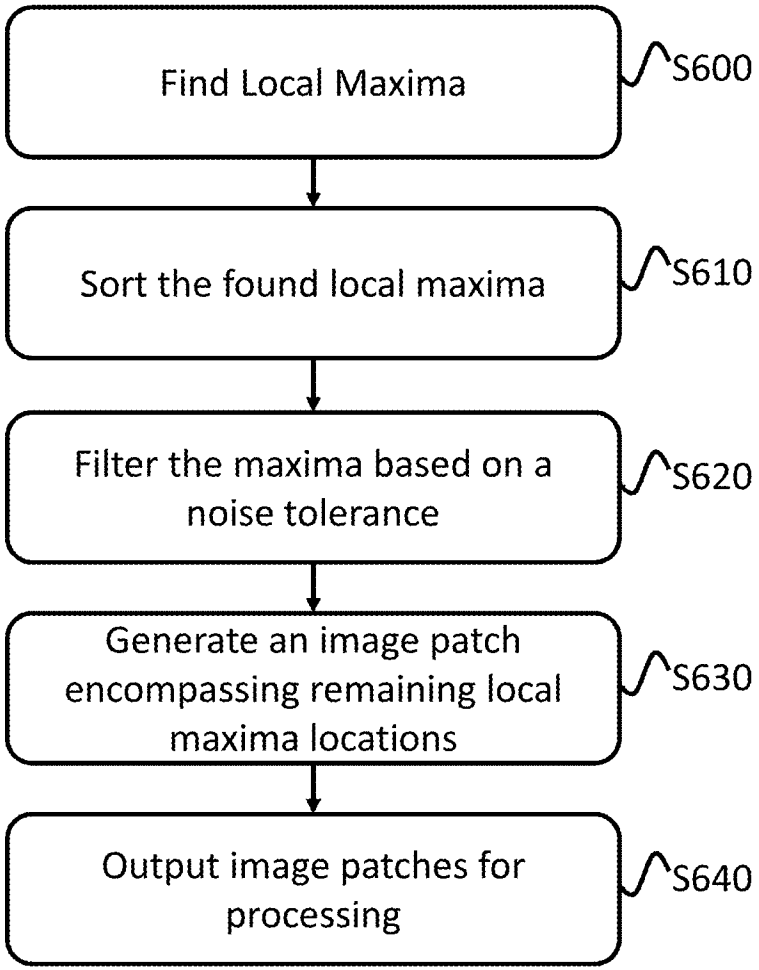
FIG. 6 depicts a method of identifying potential instances (e.g. candidates) of spot Mura according to various embodiments of the present disclosure.

In various embodiments, a spot Mura candidate detector is utilized to identify potential instances of spot Mura and generate image patches with the potential instances of spot Mura at the center of the image patches. For example, instead of splitting the entire input image 400 into a relatively large number of patches 405, the spot Mura candidate detector may be configured to identify potential instances of spot Mura and generate patches at the locations of those potential instances. For example, the instances or potential instances of spot Mura 410, 420, and 430 may be identified by the spot Mura candidate detector and the image patches 416, 424, and 434 may be generated to include the instances or potential instances of spot Mura as will be described in further detail with respect to FIGS. 5A and 5B. In various embodiments, using the spot Mura candidate detector may reduce the overall system processing time due to the reduction in the number of image patches sent to the classifier. Furthermore, the reduction in total image patches may also reduce training time when compared to the sliding window method described FIG. 5A depicts a system overview having a candidate detector according to various embodiments of the present disclosure. FIG. 5B depicts a more detailed view of a candidate detector according to various embodiments of the present disclosure. FIG. 6 depicts a method of identifying potential instances (e.g. candidates) of spot Mura according to various embodiments of the present disclosure.

Referring to FIG. 5A, in various embodiments, the system may include a preprocessor 500 configured for defect candidate detection. In various embodiments, the preprocessor 500 includes a noise reducer 510 and a candidate detector 520. In various embodiments, the noise reducer 510 may perform Gaussian smoothing to reduce the noise of the input image. The noise reducer 510 may also normalize the input image by mapping the image's dynamic range to an expected dynamic range. For example, in various embodiments the noise reducer 510 may perform linear normalization, non-linear normalization, or normalization may be done using standard deviation.

After the input image has been smoothed and normalized, the candidate detector 520 may identify potential defect candidates and generate an image patch with the candidate at the center. In various embodiments, the candidate detector 520 may identify local maxima and create a list of local maxima locations.

Referring to FIG. 5B, in various embodiments, the spot Mura candidate detector 520 may include a local maxima finder 530 and an image patch generator 570. In various embodiments, the local maxima finder 530 is configured to located potential instances of white spot Mura (e.g. a candidate) and provide the location (e.g. the center of the potential instance of white spot Mura) to the image patch generator 570. In various embodiments, the image patch generator 570 receives the candidate's location and generates an image patch around the location for use in classification.

In various embodiments, the local maxima finder includes a local maxima calculator 540. The local maxima calculator 540 is configured to identify each local maxima in the input image (S600). In various embodiments, the local maxima calculator 540 is configured to analyze either the entire input image or portions of the input image to create a list of local maxima candidate locations (e.g. the center locations of each local maxima). In some examples, the local maxima calculator 540 may be configured to iterate through the input image and identify the location of a maximum brightness within a predefined area. For example, if the system utilizes 32 pixel by 32 pixel image patches for use in classification, the local maxima calculator 540 may be configured to identify a maxima (e.g. a point with the highest brightness within the area) within each 32×32 pixel area of the input image.

In various embodiments, the list of local maxima may be provided for local maxima sorting 550. In various embodiments, the local maxima sorting 550 is configured sort the local maxima list by value (e.g. brightness) (S610). The sorted local maxima list may then be provided to the noise filter 560. In various embodiments, the noise filter 560 is configured to remove any local maxima candidates from the local maxima list that fall below a noise tolerance level (S620). For example, a noise tolerance threshold may be configured such that when a local maxima does not stand out from the surroundings by more than the noise tolerance threshold (e.g. is brighter than the surrounding area), the local maxima is rejected. For example, the threshold for whether a maxima is accepted as a candidate may be set at the maxima (e.g. maximum value for the area) minus the noise threshold and the contiguous area around the maxima may be analyzed. For example, in various embodiments, a flood fill algorithm may be used to identify each maxima above the noise tolerance threshold and identify each maxima for a given area (e.g. in some embodiments, only one maxima for an area may be allowed).

In various embodiments, the list of local maxima locations may be provided to the image patch generator 570 which then generates image patches each with a sport Mura candidates (e.g. the filtered local maxima) located at the relative center of the image patch (S630). The image patches may then be output for feature extraction and classification (S640).

Figure 7B:
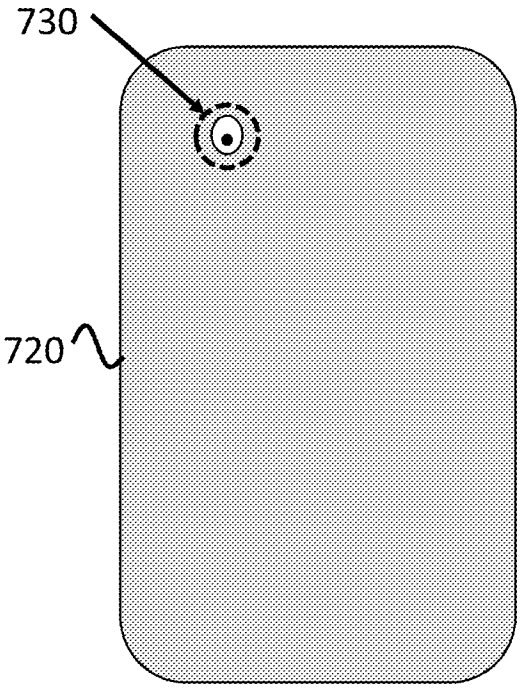
FIG. 7B. depicts a "black dot" instance on an image.
Figure 7A:
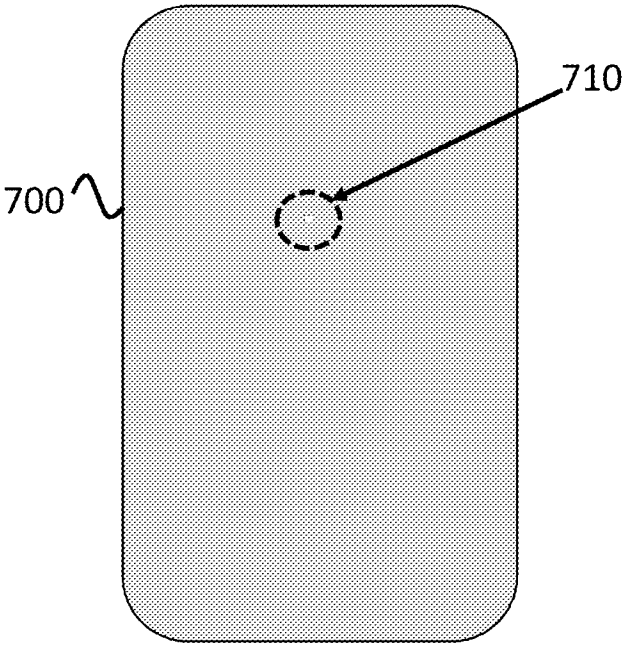
FIG. 7A depicts a "high dot" instance on an image.

FIG. 7A depicts a "high dot" instance on an image. FIG. 7B depicts a "black dot" instance on an image.

Referring to FIGS. 7A and 7B, in various embodiments, an input image may include one or more attributes that resemble white spot Mura, but are not. For example, a first image 700 may include a small white spot 710 that is not an instance of white spot Mura. For example, the small white spot may be one to several pixels in size (e.g. a relatively small portion of total number of pixels in the input image). These "high dot" instances may be considered to be a stain on the glass of the display, the camera lens, or be camera noise. Similarly in another example, a second image 720 may include a white spot with black dots 730 that is also not an instance of white spot Mura. A white spot with a black dot may be caused by various process anomalies, but is not related to white spot Mura. In either case, the classifier, such as the classifier described above, may have difficulty with properly classifying the small white spot 710, the white spot with black dots 730, and other similar attributes that resemble a white spot, but are not associated with white spot Mura. These various white spots may be difficult for the classifier to properly classify and thus reduce system accuracy. In various embodiments, an image filtering system may be utilized during candidate detection to remove "high dot," "black dot," and other non-Mura white spot instances as candidates for white spot MURA using one or more filters.

Figure 8:
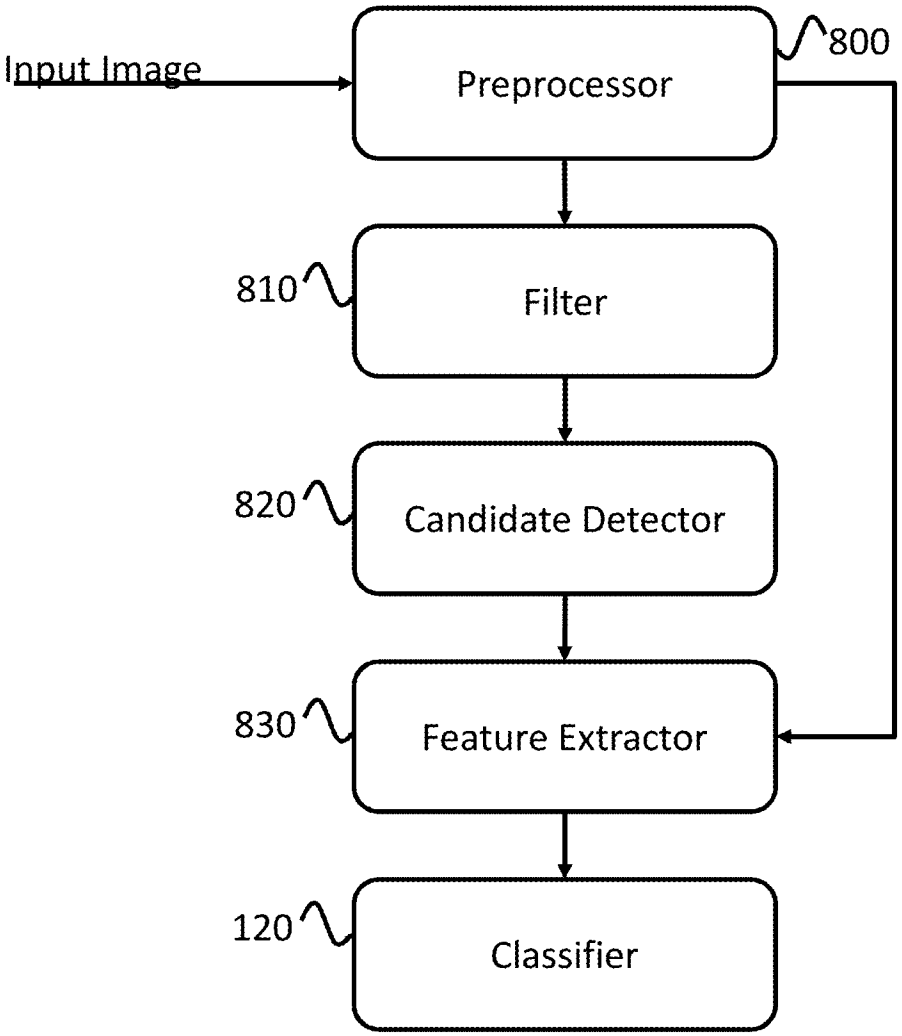
FIG. 8 depicts a Mura detection system that includes an image filtering system according to various embodiments of the present disclosure.

FIG. 8 depicts a Mura detection system that includes an image filtering system according to various embodiments of the present disclosure.

Referring to FIG. 8, in various embodiments, the Mura detection system may have an image filtering system to improve classification. In various embodiments, the image filtering system is utilized to filter input image for candidate detection. For example, in various embodiments, the preprocessor 800 receives the input image and performs image normalization as described above. In various embodiments, the preprocessor 800 provides the normalized input image to a filter 810 and the feature extractor 830.

In various embodiments, the filter 810 includes one or more filters for removing portions of the input image that may be incorrectly classified as white spot Mura. For example, the filter 810 may be configured to perform various types of image smoothing, noise reduction, or other functions to remove image attributes that are not associated with Mura. For example, in various embodiments the filter 810 may include a linear filter, a non-linear filter, or other type of filter. For example, in various embodiments, the filter 810 may be a median filter, a Gaussian filter, a Kalman filter, a nonlocal means filter, a FIR filter, a low pass filter, or any other filter. In various embodiments, the filter 810 receives and filters the normalized image to remove false candidates (e.g. false white spot Mura candidates).

In various embodiments, the candidate detector 820 receives the filtered image and determines locations of white spot Mura candidates (as described above with reference to the local maxima finder 530). The candidate detector 820 provides the locations of the white spot Mura candidates to the Feature Extractor 830.

In various embodiments, the Feature Extractor 830 receives the candidate locations and the preprocessed (e.g. normalized) input image. In various embodiments, the Feature Extractor 830 generates image patches based on the provided candidate locations using the preprocessed input image. The feature extractor 830 then calculates statistical features of each of the image patches. For example, the statistical features may include one or more image moments (e.g. a weighted average of pixels' intensities) and one or more texture measurements (e.g. texture analysis using a Gray-Level Co-Occurrence Matrix (GLCM)). The feature vectors are then provided to classifier 120 for classification.

Figure 9:
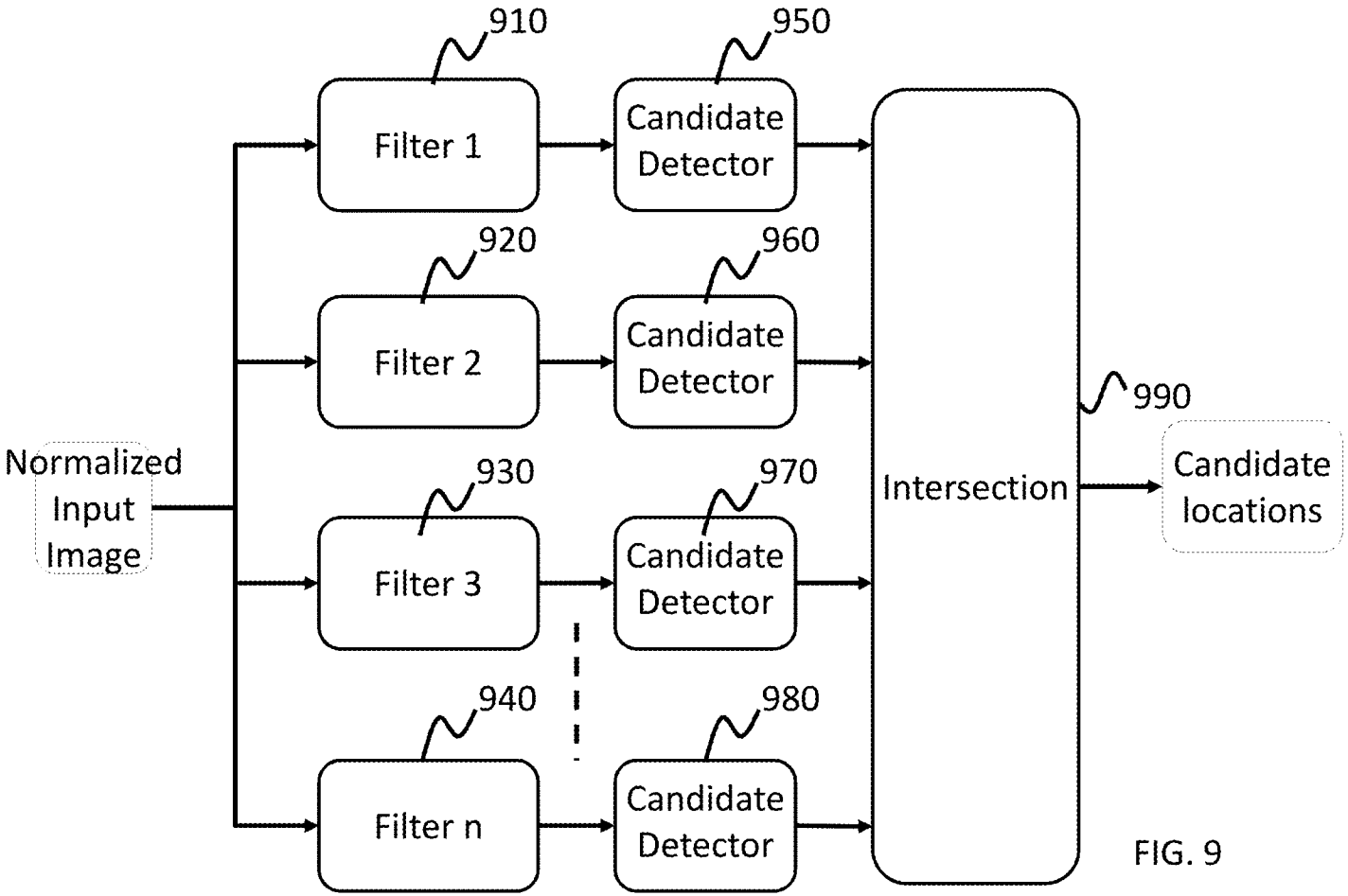
FIG. 9 depicts a filtering system according to various embodiments of the present disclosure.
Figure 10:
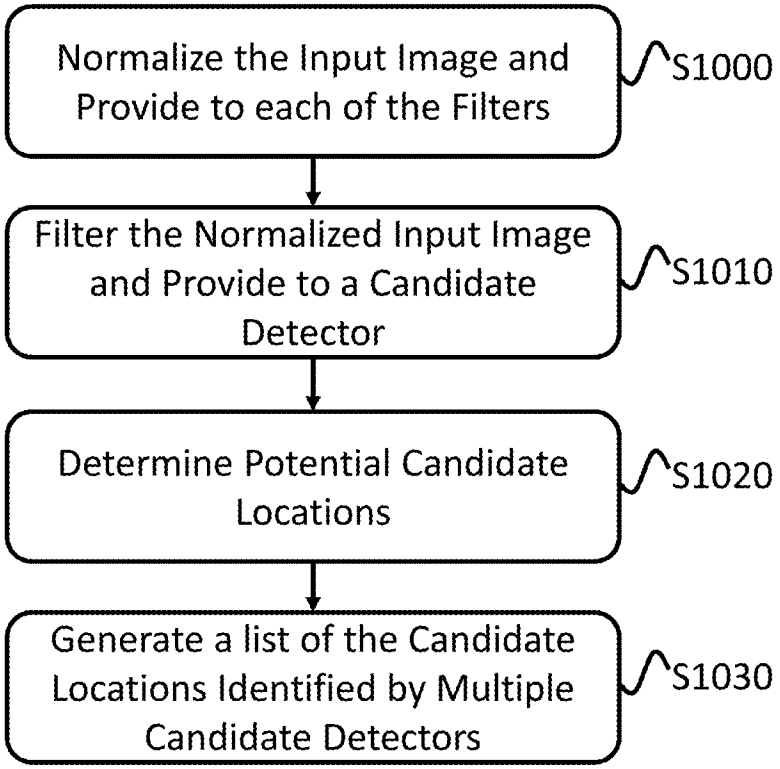
FIG. 10 depicts a method of identifying white spot Mura candidates according to various embodiments.

FIG. 9 depicts a filtering system according to various embodiments of the present disclosure. FIG. 10 depicts a method of identifying white spot Mura candidates according to various embodiments.

Referring to FIGS. 9 and 10, in various embodiments the Mura detection system may utilize a filtering system having multiple filters and candidate detectors to remove false candidates from an input image by smoothing/reducing noise from the input image. For example, in various embodiments, the filtering system has a plurality of filters 910-940 and a plurality of candidate detectors 950-980. For example, in various embodiments, each filter 910-940 may be paired with a corresponding candidate detector 950-980. In various embodiments, each filter may utilize a different noise reducing or image smoothing filter. For example, in various embodiments, the a first filter 910 may be a median filter, the second filter 920 may be a Gaussian filter, a third filter 930 may be a nonlocal means filter, and a fourth filter 940 may be a FIR filter. In various embodiments, the same filter type may be used more than once with different parameters. For example, in various embodiments, multiple median filters may be used with each of the median filters having a different window size or multiple Gaussian filters having different standard deviations may be used.

In various embodiments, the input image (e.g. a normalized input image) is provided to each of the filters 910-940 (S1000). In various embodiments, each of the filters 910-940 receive the input image and produces a filtered image that is provided to a candidate detector 950-980 (S1010). In various embodiments, each of the filters operates concurrently (e.g. substantially simultaneously). Each candidate detector 950-980 receives a filtered image is configured to find local maxima as described above with reference to the local maxima finder 530. In various embodiments, the candidate detectors 950-980 each provide any potential candidate locations to the intersection 990 (S1020). In various embodiments, each of the candidate detectors 950-980 operates concurrently (e.g. substantially simultaneously).

In various embodiments, the intersection 990 identifies candidate locations that were identified by multiple candidate detectors 950-990 and outputs a list of the identified candidate locations for feature extraction (S1030). For example, in various embodiments, the intersection 990 identifies locations where every candidate detector provided a candidate. In other embodiments, the intersection 990 identifies locations where at least two candidate detectors identified a candidate.

Figure 11:
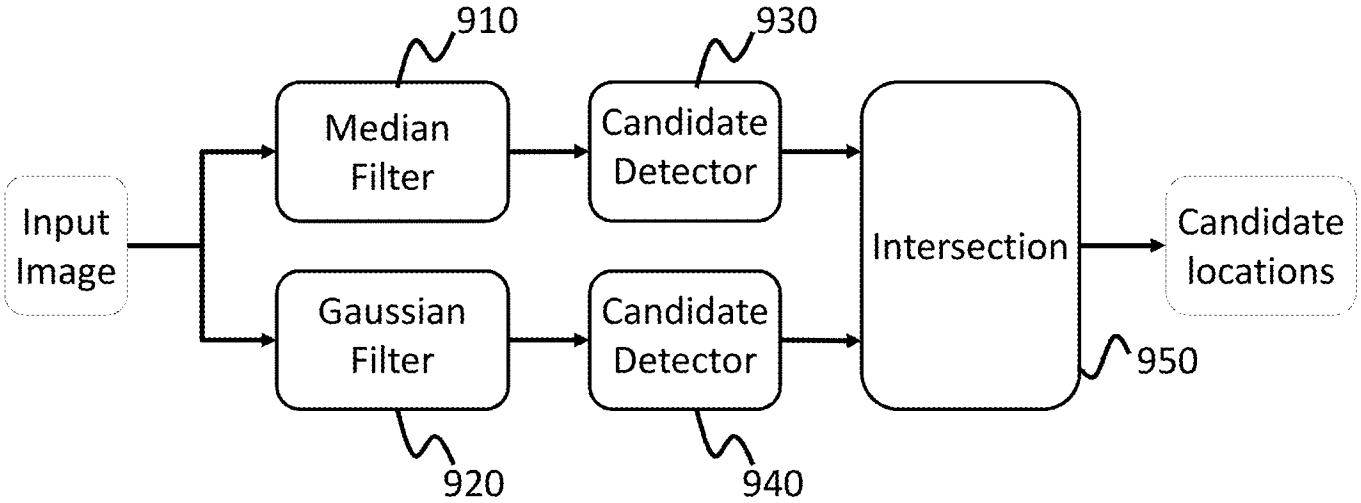
FIG. 11 depicts a filtering system having multiple filters and candidate detectors according to various embodiments of the present disclosure.

FIG. 11 depicts a filtering system having multiple filters and candidate detectors according to various embodiments of the present disclosure.

Referring to FIG. 11, in various embodiments, the Mura detection system has a filtering system with a median filter 1110 and a Gaussian filter 1120 for filtering the input image. In various embodiments, a median filter may be used on the input image to replace an image value with the median value of its neighbors. In various embodiments, median filters are effective for removing small abnormalities in an image such as a "high dot" instance and image noise, or for removing the black dots in a "black dot" instance. In various embodiments, a Gaussian filter may be configured to blur the image according to a Gaussian function resulting in a soothing of the image and reduction in small abnormalities in an image. The Gaussian filter is similarly effective for removing small abnormalities in an image such as a "high dot" instance and image noise, or for removing the black dots in a "black dot" instance.

In various embodiments, the median filter 1110 uses 3 pixel by 3 pixel windows. In various embodiments, the Gaussian filter 1120 uses a 3 pixel by 3 pixel window and a standard deviation of about 2 in the x direction and about 2 in the y direction. In various embodiments, the median filter 1110 and the Gaussian filter 1120 filter the entire input image. In various embodiments, a first candidate detector 1130 receives the median filtered input image and performs candidate detection to generate a first list of potential candidate locations. In various embodiments, the second candidate detector 1140 receives the Gaussian filtered input image and performs candidate detection to generate a second list of potential candidate locations. In various embodiments, the intersection 1150 compares the first list of potential candidate locations with the second list of potential candidate locations and generates a final list of candidate locations filled with locations that appear on both the first list and the second list. The final list of candidate locations is then output for feature extraction and classification.

Accordingly, the above described embodiments of the present disclosure provide a system and method for identifying instances of Mura on a display panel. In various embodiments, a filtering system may reduce the number of candidate image patches classified. Reducing the number of image patches for classification reduces the total classification time. Additionally, the filtering system improves overall classification accuracy by removing image attributes that may be incorrectly classified as white spot Mura.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure." As used herein, the terms "use," "using," and "used" may be considered synonymous with the terms "utilize," "utilizing," and "utilized," respectively. Also, the term "exemplary" is intended to refer to an example or illustration.

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present disclosure.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

What is claimed is:

1. A system for identifying Mura candidate locations in a display, the system comprising:

a memory;

a processor configured to execute instructions stored on the memory that, when executed by the processor, cause the processor to:

generate a first filtered image by filtering an input image using a first image filter;

determine first potential candidate locations using the first filtered image;

generate a second filtered image by filtering an input image using a second image filter;

determine second potential candidate locations using the second filtered image;

produce a list of candidate locations, wherein the list of candidate locations comprises locations in both the first potential candidate locations and the second potential candidate locations; and generate image patches for each candidate location in the list of candidate locations.

2. The system of claim 1, wherein the first image filter comprises a median filter and the second image filter comprises a Gaussian filter.

3. The system of claim 1, wherein the image patches each comprise a portion of the input image centered at the candidate location.

4. The system of claim 3, further comprising extracting a feature vector for each of the image patches.

5. The system of claim 4, further comprising classifying the image patches, using a machine learning classifier, using the feature vector to determine when each image patch has white spot Mura.

6. The system of claim 5, wherein the machine learning classifier comprises a support vector machine.

7. The system of claim 1, wherein determining potential candidate locations comprises:

identifying at least one local maxima candidate in the first filtered input image;

adding each identified local maxima candidate to a candidate list; and filtering local maxima candidates in the candidate list by removing each local maxima candidate from the candidate list when the local maxima candidate has a value less than a noise tolerance threshold.

8. The system of claim 1, wherein the instructions further cause the processor to preprocess the input image, wherein preprocessing the input image comprises performing Gaussian smoothing on the input image and normalizing the smoothed input image by mapping a dynamic range of the smoothed input image to an expected range.

9. A method for identifying Mura candidate locations in a display comprising:

generating a first filtered image by filtering an input image using a first image filter;

determining first potential candidate locations using the first filtered image;

generating a second filtered image by filtering an input image using a second image filter;

determining second potential candidate locations using the second filtered image;

producing a list of candidate locations, wherein the list of candidate locations comprises locations in both the first potential candidate locations and the second potential candidate locations; and generating image patches for each candidate location in the list of candidate locations.

10. The method of claim 9, wherein the first image filter comprises a median filter and the second image filter comprises a Gaussian filter.

11. The method of claim 9, wherein the image patches each comprise a portion of the input image centered at the candidate location.

12. The method of claim 11, further comprising extracting a feature vector for each of the image patches.

13. The method of claim 12, further comprising classifying the image patches, using a machine learning classifier, using the feature vector to determine when the image patch has white spot Mura.

14. The method of claim 13, wherein the machine learning classifier comprises a support vector machine.

15. The method of claim 9, wherein determining potential candidate locations comprises:

identifying at least one local maxima candidate in the first filtered input image;

adding each identified local maxima candidate to a candidate list; and filtering local maxima candidates in the candidate list by removing each local maxima candidate from the candidate list when the local maxima candidate has a value less than a noise tolerance threshold.

16. The method of claim 9, further comprising preprocessing the input image, wherein preprocessing comprises performing Gaussian smoothing on the input image and normalizing the smoothed input image by mapping a dynamic range of the smoothed input image to an expected range.

17. A method for identifying Mura candidate locations in a display comprising:

generating a first filtered image by filtering an input image using a first image filter;

determining first potential candidate locations using the first filtered image;

generating a second filtered image by filtering an input image using a second image filter;

determining second potential candidate locations using the second filtered image;

producing a list of candidate locations, wherein the list of candidate locations comprises locations in both the first potential candidate locations and the second potential candidate locations;

generating image patches for each candidate location, wherein the image patches each comprise a portion of the input image centered at the candidate location;

extracting a feature vector for each of the image patches; and classifying the image patches, using a machine learning classifier, using the feature vector to determine when the image patch has white spot Mura.

18. The method of claim 17, wherein the first image filter comprises a median filter and the second image filter comprises a Gaussian filter.

19. The method of claim 17, wherein the machine learning classifier comprises a support vector machine.

20. The method of claim 17, wherein determining potential candidate locations comprises:

identifying at least one local maxima candidate in the first filtered input image;

adding each identified local maxima candidate to a candidate list; and filtering local maxima candidates in the candidate list by removing each local maxima candidate from the candidate list when the local maxima candidate has a value less than a noise tolerance threshold.

* * * * *